US007667446B2

(12) United States Patent
Williams et al.

(10) Patent No.: US 7,667,446 B2
(45) Date of Patent: Feb. 23, 2010

(54) METHOD FOR CONTROLLING CURRENT IN A LOAD

(75) Inventors: Kyle Williams, Howell, MI (US); Joseph Funyak, Rochester Hills, MI (US)

(73) Assignee: Infineon Technologies AG, Munich (DE)

( * ) Notice: Subject to any disclaimer, the term of this patent is extended or adjusted under 35 U.S.C. 154(b) by 400 days.

(21) Appl. No.: 11/652,344

(22) Filed: Jan. 11, 2007

(65) Prior Publication Data

US 2008/0169798 A1 Jul. 17, 2008

(51) Int. Cl.
*G05F 1/575* (2006.01)
*G05F 1/56* (2006.01)

(52) U.S. Cl. ..... 323/284; 323/283

(58) Field of Classification Search ..... 323/282, 323/283, 284, 285, 351
See application file for complete search history.

(56) References Cited

U.S. PATENT DOCUMENTS 5,883,536 A 3/1999 Patterson
6,069,471 A * 5/2000 Nguyen ..... 323/271
6,433,522 B1 * 8/2002 Siri ..... 323/272
6,504,698 B1 1/2003 Durif et al.
6,809,504 B2 * 10/2004 Tang et al. ..... 323/274
7,466,116 B2 * 12/2008 Sato et al. ..... 323/285
7,521,907 B2 * 4/2009 Cervera et al. ..... 323/268
2007/0145965 A1 * 6/2007 Oswald et al. ..... 323/286
2008/0238391 A1 10/2008 Williams et al.

FOREIGN PATENT DOCUMENTS

DE 4019218 A1 12/1990
DE 69800081 T2 9/2000
DE 102004010914 A1 9/2005
DE 60309155 T2 8/2007

OTHER PUBLICATIONS

Office Action dated Oct. 7, 2009 issued to U.S. Appl. No. 11/731,722.

* cited by examiner

*Primary Examiner*—Gary L Laxton
(74) *Attorney, Agent, or Firm*—Eschweiler & Associates, LLC

(57) ABSTRACT

One embodiment relates to a control system. The control system includes a controller configured to drive a load based on a set-point of the load. The controller is also configured to measure a load characteristic of the load and compute an average load characteristic. The controller is further configured to determine a corrected set-point based on the computed average and to drive the load in response to the corrected set-point. Other systems and methods are also disclosed.

21 Claims, 7 Drawing Sheets

METHOD FOR CONTROLLING CURRENT IN A LOAD

FIELD OF THE INVENTION

The present invention relates generally to control methods and systems, and more specifically to a compensated hysteretic control system for controlling an average load characteristic associated with a load.

BACKGROUND OF THE INVENTION

In many facets of today's rapidly changing economy, successful businesses must deliver quality products and maximize value to their customers to survive. Even in the high-tech electronic controls arena, this simple reality still holds true.

Two ways in which control systems suppliers deliver value is by providing more accurate control solutions and by providing faster controllers. Accordingly, there is a need in the electronics industry to deliver a control system that can drive a load faster and more accurately.

SUMMARY OF THE INVENTION

The following presents a simplified summary of the invention in order to provide a basic understanding of some aspects of the invention. This summary is not an extensive overview of the invention, and is neither intended to identify key or critical elements of the invention nor to delineate the scope of the invention. Rather, the purpose of the summary is to present some concepts of the invention in a simplified form as a prelude to the more detailed description that is presented later.

In one embodiment, a control system measures and compensates a current for driving a load. The control system includes a controller configured to measure a load characteristic of a load at an input thereof, to drive the load based on a set-point of the load, and to compute an average load characteristic. The controller of the control system is further configured to determine a corrected set-point based on the computed average, and to drive the load in response to the corrected set-point to a desired load characteristic value.

The following description and annexed drawings set forth in detail certain illustrative aspects and implementations of the invention. These are indicative of but a few of the various ways in which the principles of the invention may be employed.

DETAILED DESCRIPTION OF THE INVENTION

The present invention will now be described with respect to the accompanying drawings in which like numbered elements represent like parts. The figures and the accompanying description of the figures are provided for illustrative purposes and do not limit the scope of the claims in any way.

Figure 1:
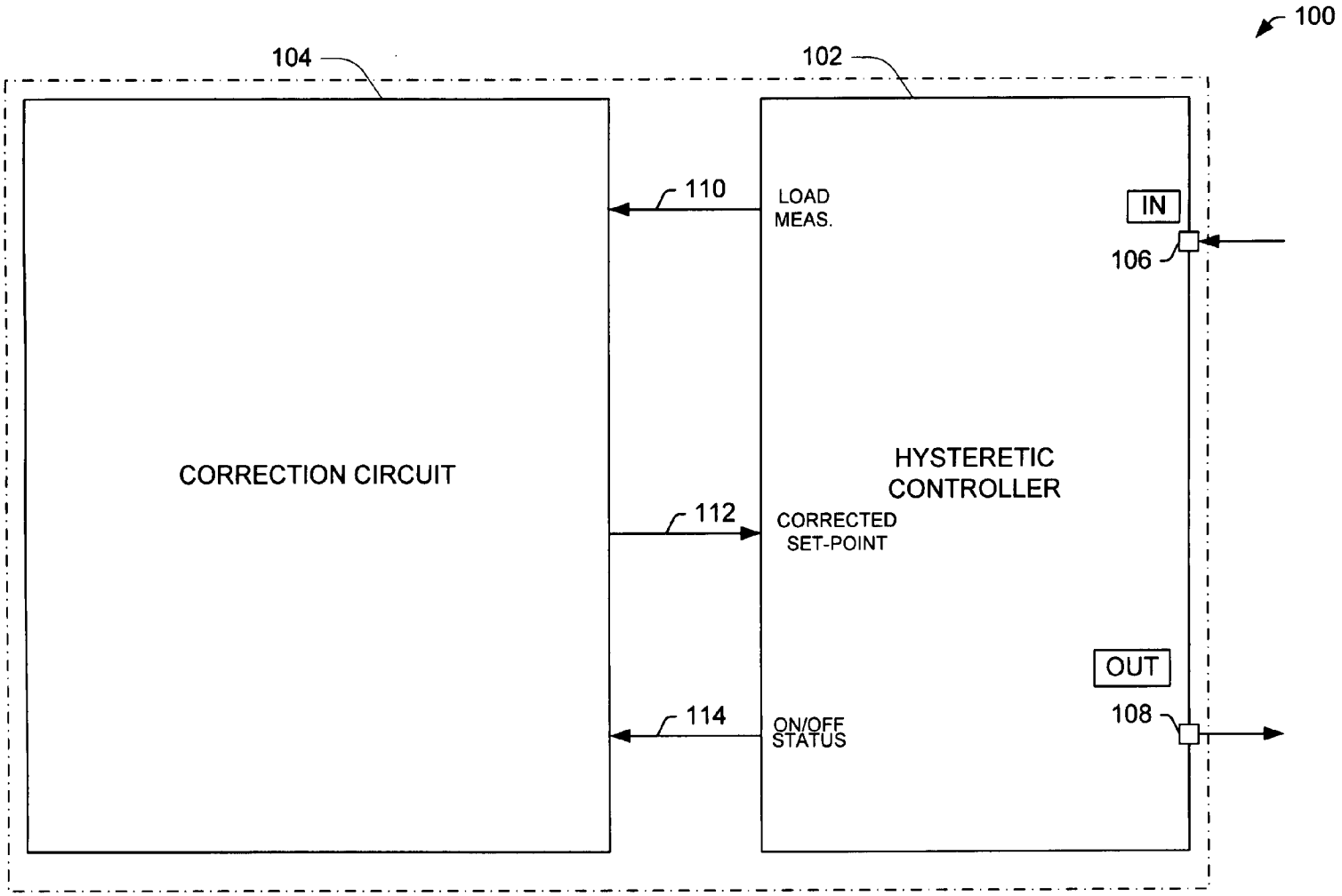
FIG. 1 is a block diagram of one embodiment of a control system for driving a load.

FIG. 1 shows one embodiment for a compensated hysteretic control system 100 comprising a controller 102 configured to measure a load characteristic of a load (not shown) at an input 106 thereof, and further configured to drive the load based on a set-point of the load. The control system 100 further comprises a correction circuit 104 configured to compute an average load characteristic, and to determine a corrected set-point based on the computed average. The controller is also configured to drive the load when operably coupled to an output 108 thereof in response to the corrected set-point.

In one embodiment, the compensated hysteretic control system 100 comprises a hysteretic controller 102 that is configured to digitally measure a load characteristic (in other embodiments, a load current, a voltage, a magnetic field, a light energy, and a power) of a load (in other embodiments, a solenoid, a motor, a light, an inductive load) at an input 106 thereof, and further can drive the load based on a set-point (in other embodiments, a load current set-point, a voltage set-point, a magnetic field set-point, a light energy set-point, and a power set-point) of the load. The control system 100 of the embodiment also has a correction circuit 104 that can compute an average load characteristic using the measured load characteristic 110 over an integer number of cycles (in other embodiments, load switching cycles, or the cycles of another signal time base source).

The correction circuit 104 of the present embodiment is configured to determine a corrected set-point 112 from the computed average, by comparing (in other embodiments, comparing or computing the difference between two values) the average load characteristic to a first set point (in other embodiments, a predetermined, initial set-point, user supplied setting, programmed setting), and summing the result of this comparison with the initial set-point and a hysteretic band value (in other embodiments, peak, or peak-to-peak band of allowed variation of the load characteristic values). The controller then drives the load when operably coupled to an output 108 thereof in response to the second or corrected set-point 112 determined by the correction circuit 104, and optionally, to provide an on/off status indication 114 of the drive output 108.

Figure 2A:
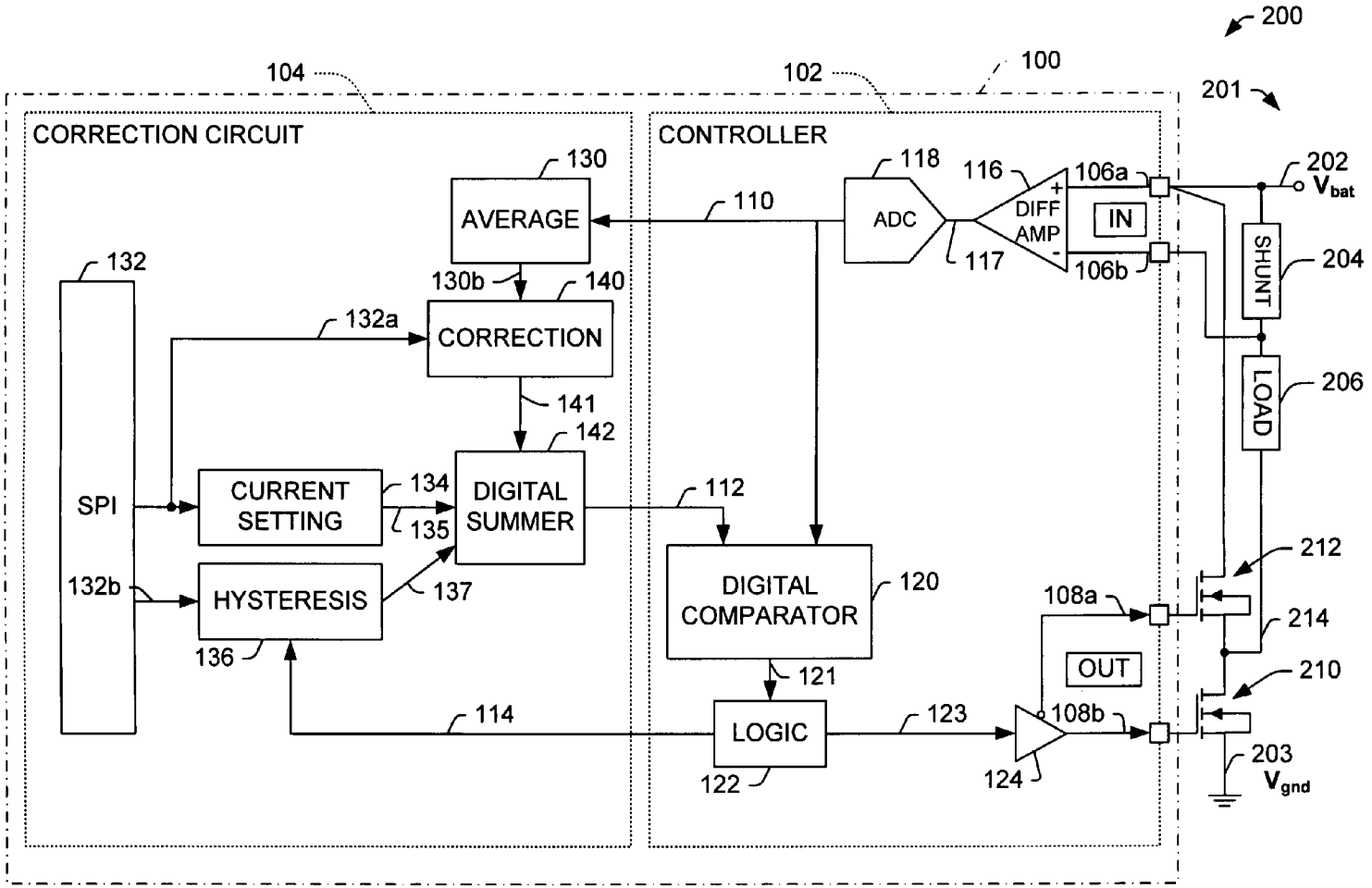
FIGS. 2A and 2B are block diagrams of embodiments of the control system of FIG. 1 used for driving a load.
Figure 2B:
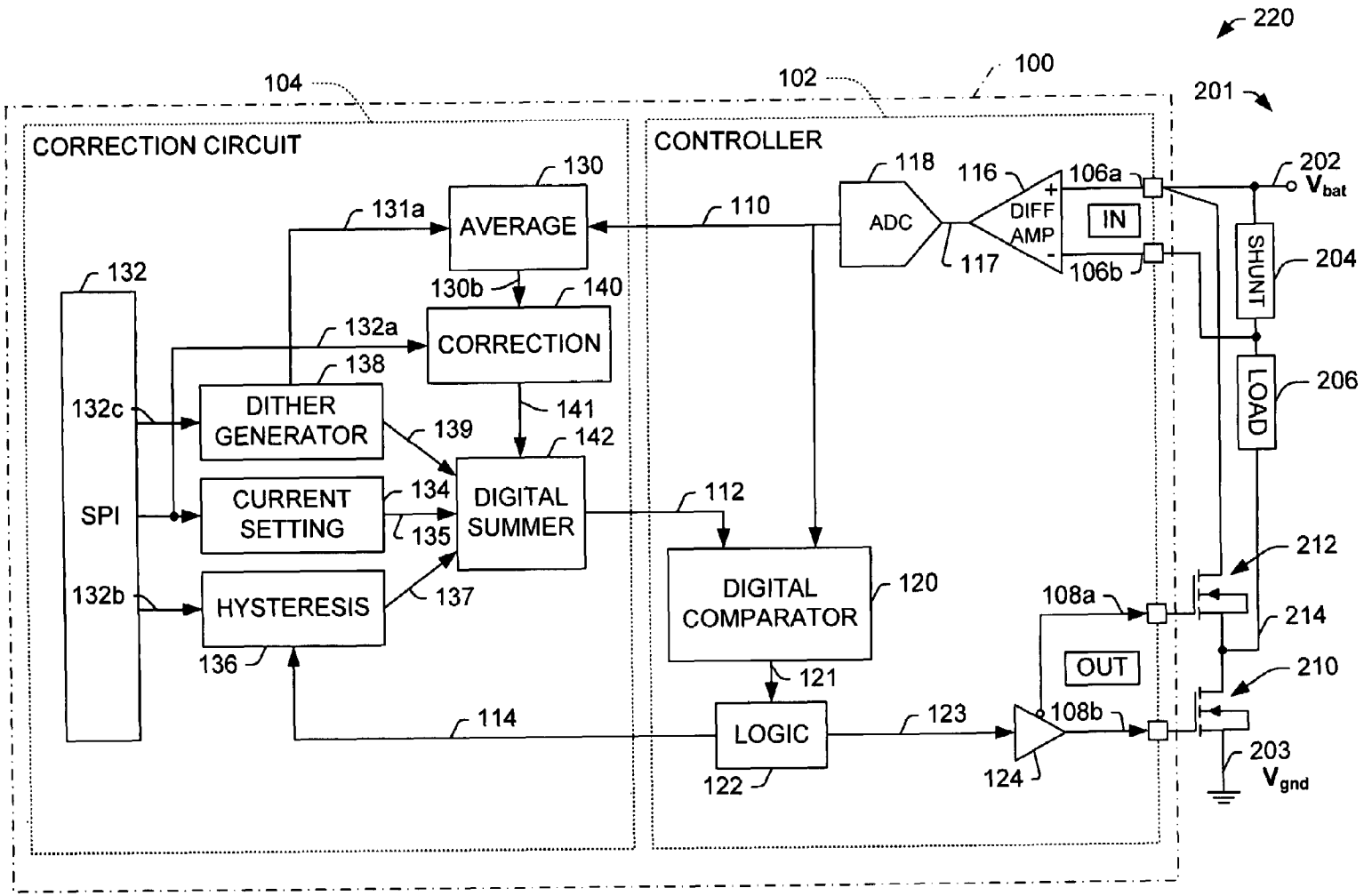

FIGS. 2A and 2B illustrate embodiments of the compensated hysteretic control system of FIG. 1 used for driving a load in accordance with the present invention.

FIG. 2A, for example, illustrates one embodiment of a compensated hysteretic control system 200 similar to that of FIG. 1. Control system 200 comprises a hysteretic controller 102, a correction circuit 104, and several external drive and load components 201 including a shunt resistor 204 and a load 206, which are driven by complementary drive transistors 210 and 212 driven from differential drive outputs 108*a*, 108*b* of controller 102. The external drive and load components 201 receive supply power between supply voltage Vbat 202 and ground voltage Vgnd 203. The control system 200 of the embodiment can manage, in one embodiment, a current that is delivered to the load 206 (in other embodiments, a solenoid, a motor, a light, or an inductive load) by selectively increasing or decreasing the current to properly drive the load, such that the current is maintained by driving (in one embodiment switching) the load between a preset upper limit and lower limit, sometimes called hysteretic switching, accomplished within a hysteretic band as will be discussed further in association with FIG. 3 infra. The frequency of this load switching may be determined by the particular load characteristics, the supply voltage used, and the hysteretic band chosen.

In the illustrated embodiment of FIG. 2A, the controller 102 has a pair of differential inputs 106*a*, 106*b* which sense a voltage drop across the shunt resistor 204 proportional to the load current thru load 206. A Hall Effect sensor may also be used at the input 106, wherein a magnetic field is associated with the current in the load 206, and a voltage proportional to the magnetic field may be provided as the load characteristic input. Thus, as the current through the shunt resistor 204 or Hall Effect sensor, for example, increases, the shunt resistor or sensor voltage typically increases proportionally. Similarly, as the current through the sensor decreases, the sensor voltage typically decreases proportionally, although other conventions could also be used.

After the shunt resistor 204 provides the sensed voltage, the sensed voltage travels to the pair of differential inputs 106*a*, 106*b* of the controller 102, one embodiment of which is now discussed in more detail.

Differential amplifier 116 senses the differential voltage at 106*a*, 106*b*, for example, or another such load characteristic (in other embodiments, a load current, a voltage, a magnetic field, a light energy, and a power) indicative of the load, which is communicated at 117 to an analog to digital converter ADC 118, which are well known in the art. ADC 118 provides a digital measurement 110 of the load current, or another such load characteristic to a digital comparator 120 in the controller 102 and to an averaging functional block 130 in the correction circuit 104.

Where a desired set-point of the load characteristic is compared to the measured load characteristic in an analog comparator, in the embodiment of FIG. 2A, the digital comparator receives a corrected set-point 112 that provides an accurate representation of a measured average of the load characteristic. Accordingly, the averaging block 130 receives the measured load characteristic 110 (in one embodiment, a load current), over a known time interval, or a number of cycles of a signal source used as a time base such as the load switching cycles or a dither signal, for example, and computes the average load characteristic 130*b* measured over this time interval. A synchronous serial peripheral interface SPI 132 or another such interface may be used to supply an initial set-point of the load characteristic (in one embodiment an initial current setting) 132*a* to a current setting functional block 134 and a correction block 140, and a hysteretic band value 132*b* supplied to a hysteresis functional block 136.

The correction block 140 compares or computes the difference between the computed average load characteristic 130*b* and the initial set-point 132*a* to obtain a correction error 141. The correction error 141 is then summed in a digital summer functional block 142 in one embodiment with a digital representation of the initial set-point 135 provided by the current setting block 134 and a hysteretic band value 137 from hysteresis block 136 used to determine whether to add or subtract the hysteretic band value 132*b* supplied by SPI 132, based upon the on/off status 114 indicated by logic block 122.

The summation (or other suitable operation in other embodiments) within the digital summer 142 results in a corrected set-point 112 from the correction circuit 104 to the digital comparator 120 of the controller 102. Digital comparator 120 then compares the corrected set-point 112 with the measured load characteristic 110 to provide a drive command signal 121 to logic block 122. Logic block 122 then issues a drive signal to output driver 124 to drive or switch the external drive transistors 210 and 212, and also issues the on/off status 114 to hysteresis block 136 to indicate whether the load is being driven in a direction that will increase or decrease the load characteristic. Thus the present embodiment of the invention may be used to regulate the average load characteristic of a load, for example, a load current of a solenoid.

In one embodiment of the correction circuit 104, the synchronous serial peripheral interface SPI 132 or another such interface may be used to supply the initial settings for the required load characteristic set-points (in one embodiment, a 500 mA load current), the hysteretic band value (in one embodiment +/−10 mA load current), the dither amplitude (in one embodiment 150 mA P-P), the dither frequency (in one embodiment 175 Hz), or the number of dither cycles to average over (in one embodiment 4 dither cycles), for example.

In an embodiment of the correction circuit 104, the digital summer functional block 142 may comprise a digital adder or subtractor, or another such processor function capable of summing or mixing the initial set-point 135, the hysteretic band value 137, the error correction value 141, and optionally the amplitude component 139 of the dither signal, to supply a corrected set-point 112.

In one embodiment of the controller 102, the output 121 (in one embodiment a digital word result) of the comparator 120 is provided to the logic block 122 to provide a logical drive signal 123 to a gate driver or an output driver 124 and an on/off status 114 to the hysteresis block 136. This logical drive signal 123 may, for example, be delayed or be related to the comparator output signal 121 by some other state-machine included in the logical block in one embodiment. The logical drive signal 123 is then passed to the gate driver or output driver 140, which may amplify or otherwise condition the signal to provide the drive signal on 108*b* and the inverted drive signal on 108*a* to a first field effect transistor FET 210 and a second field effect transistor FET 212, respectively.

Thus, the control system 100 in one embodiment measures and adjusts a load characteristic of a load 206, for example, a load current between an upper limit and a lower limit to efficiently and accurately drive the load, wherein the output driver 124, in one embodiment, may be a single ended or a differential driver capable of driving one or more external or internal drive transistors, for example.

FIG. 2B, illustrates another embodiment of a control system 220, having a compensated hysteretic control system 100, comprising a controller 102 and a correction circuit 104, and external load and drive components 201. Control system 220 is similar to control system 200 of FIG. 2A, and as such need not be completely described again for the sake of brevity. In this embodiment, correction circuit 104 further comprises a dither generator 138 that provides a dither signal based upon amplitude and frequency settings 132*c* supplied by SPI 132. The dither generator 138 provides a substantially continuous motion to the load (in other embodiments, the core or armature of a solenoid or a motor) when operably coupled thereto, and provides a time base source for the average block 130 via 131*a* for computing the average load characteristic 130*b* over an integer number of dither cycles. The amplitude component 139 of the dither signal is also summed (or otherwise accounted for) in the present embodiment of FIG. 2B in summer block 142 with the initial set-point 135, the hysteretic band value 137, and the error correction value 141, to supply a corrected set-point 112, which is further based on the dither signal amplitude and period settings 132*c*.

The dither block 138 receives the base dither frequency or period, in one embodiment, which it then suitably modifies to facilitate providing the time base signal at 131*a* and the amplitude component 139. In one embodiment, the dither block 138 provides a periodic wave that is a triangular wave of approximately 150 to 200 Hz that corresponds to the frequency at which the load oscillates about an initial set-point. For example, in one embodiment where the load 206 includes a solenoid, the dither block 138 provides a periodic wave that is superimposed on the average current to move the solenoid armature back and forth to avoid static friction (stiction).

Figure 3:
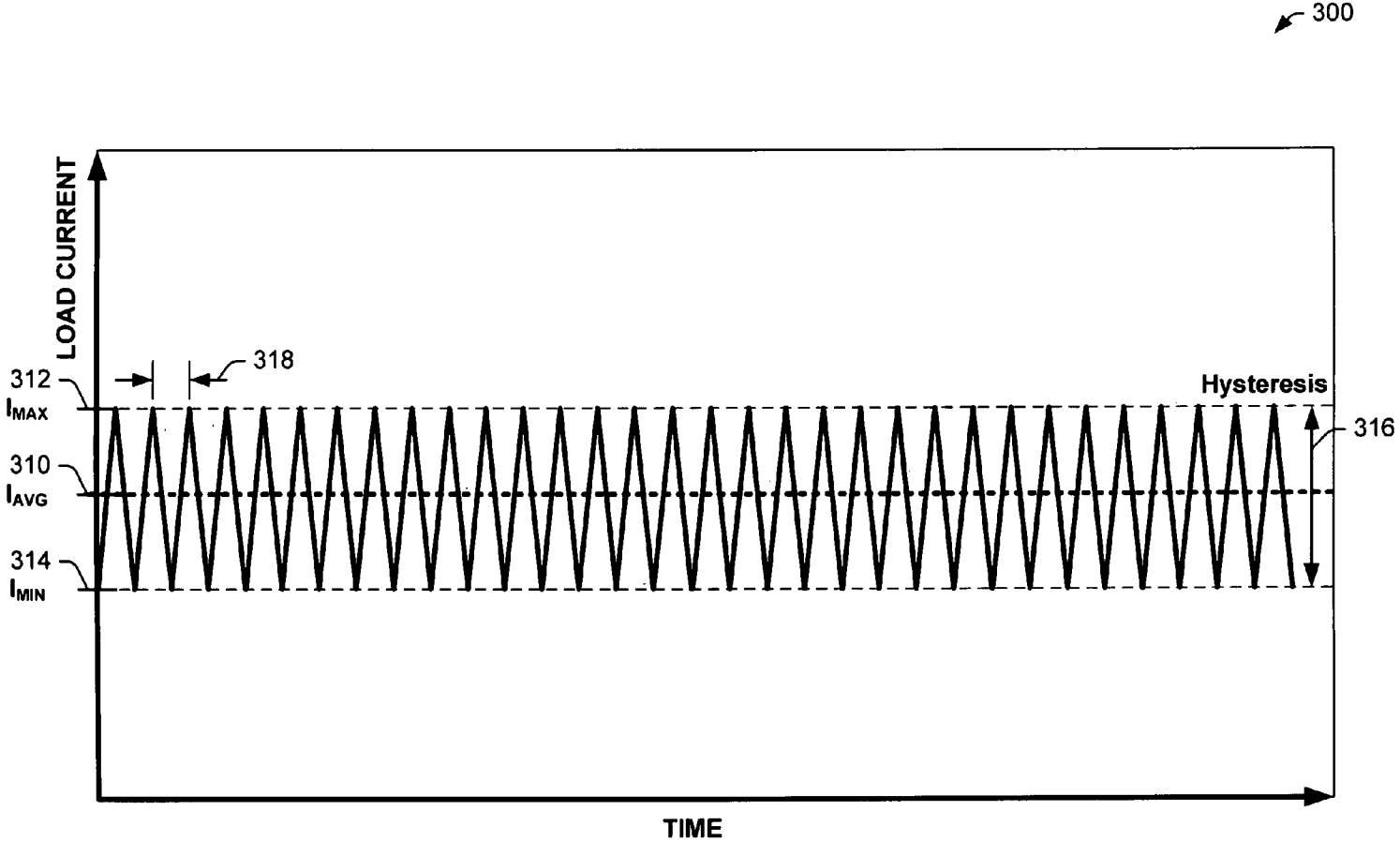
FIG. 3 is an output waveform of the control system of FIG. 2A while driving the load.

FIG. 3 illustrates an output waveform 300 of the control system embodiment 200 of FIG. 2A while driving the load 206. The load characteristic, or load current, for example is maintained at an average load current $I_{AVG}$ 310, by driving (in one embodiment, switching) the load 206 between preset upper limit $I_{MAX}$ 312 and lower limit $I_{MIN}$ 314, which define a hysteretic band 316. The hysteretic band 316 may be programmed along with other initial settings, for example, within the serial interface SPI 132. The frequency or period 318 of this load switching is generally determined by the particular load characteristics, the supply voltage used, and the hysteretic band 316 chosen.

Figure 4:
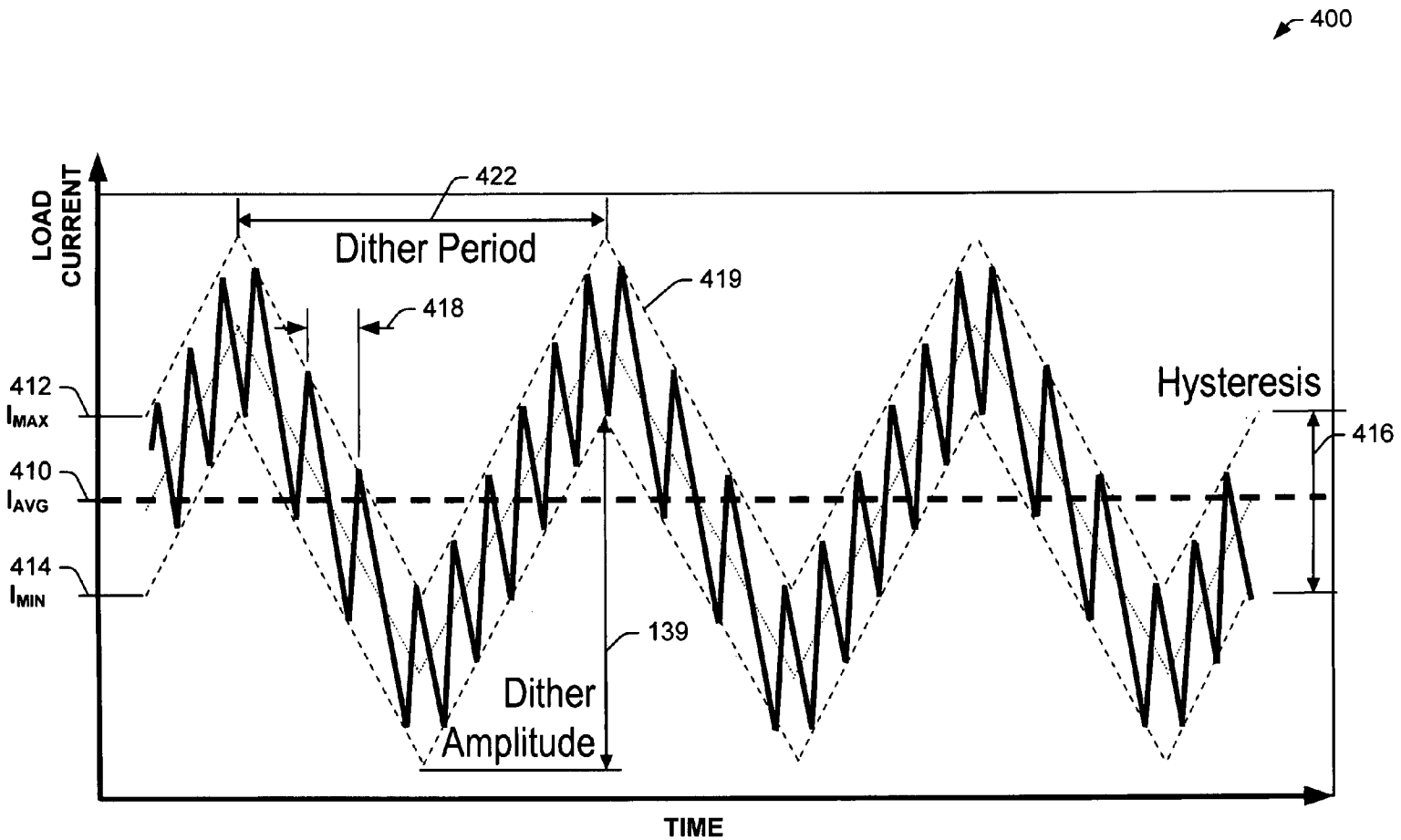
FIG. 4 is an output waveform of the control system of FIG. 2B while driving the load.

FIG. 4 illustrates an output waveform 400 of the control system embodiment 220 of FIG. 2B having a dither signal 419, and driving the load 206. The load characteristic, or load current, for example is maintained at an average load current $I_{AVG}$ 410, by driving (in one embodiment, switching) the load 206 between preset upper limit $I_{MAX}$ 412 and lower limit $I_{MIN}$ 414, which define a hysteretic band 416. The hysteretic band 416 may be programmed along with other initial settings, for example, within the SPI 132. The frequency or period 418 of this load switching is generally determined by the particular load characteristics, the supply voltage used, and the hysteretic band 416 chosen.

In addition, the dither signal 419 having a dither amplitude 139 and a dither frequency or dither period 422, may be provided in the dither settings 132*c* supplied by serial interface SPI 132. The dither generator 138 may be used to provide a substantially continuous motion to the load (in other embodiments, the core or armature of a solenoid or a motor) when operably coupled thereto, and provides a time base source for the average block 130 via 131*a* for computing the average load characteristic 130*b* over an integer number of dither cycle periods 422. The amplitude component 139 of the dither signal is summed (or otherwise accounted for) in the embodiment of FIG. 2B in summer block 142 with the initial set-point 135, the hysteretic band value 137, and the error correction value 141, to supply a corrected set-point 112, which is further based on the dither signal amplitude 139 and period settings 132*c*. From FIG. 2B, it may be observed that the output waveform 400 essentially comprises the dither signal 419 as an AC signal riding on, or summed with the hysteretic load switching signal or output waveform 300 of FIG. 3 without dither.

In one embodiment, the control system 100 can provide an average current upon which a periodic wave is superimposed and wherein the periodic wave has a frequency that is associated with a load switching frequency at which the load is driven, for example, at a frequency of about 2-10 Khz, depending upon the load characteristics, the supply voltage, and the hysteresis band value chosen for the system.

In addition to or in substitution of one or more of the illustrated components, the illustrated hysteretic control system and other systems of the invention include suitable circuitry, state machines, firmware, software, logic, etc. to perform the various methods and functions illustrated and described herein, including but not limited to the methods described below. While the methods illustrated herein are illustrated and described as a series of acts or events, it will be appreciated that the present invention is not limited by the illustrated ordering of such acts or events. For example, some acts may occur in different orders and/or concurrently with other acts or events apart from those illustrated and/or described herein, in accordance with the invention. In addition, not all illustrated steps may be required to implement a methodology in accordance with the present invention. Furthermore, the methods according to the present invention may be implemented in association with the operation of systems which are illustrated and described herein (in other embodiments, circuit 100 of FIGS. 1, 2A, and 2B) as well as in association with other systems not illustrated, wherein all such implementations are contemplated as falling within the scope of the present invention and the appended claims.

Figure 5:
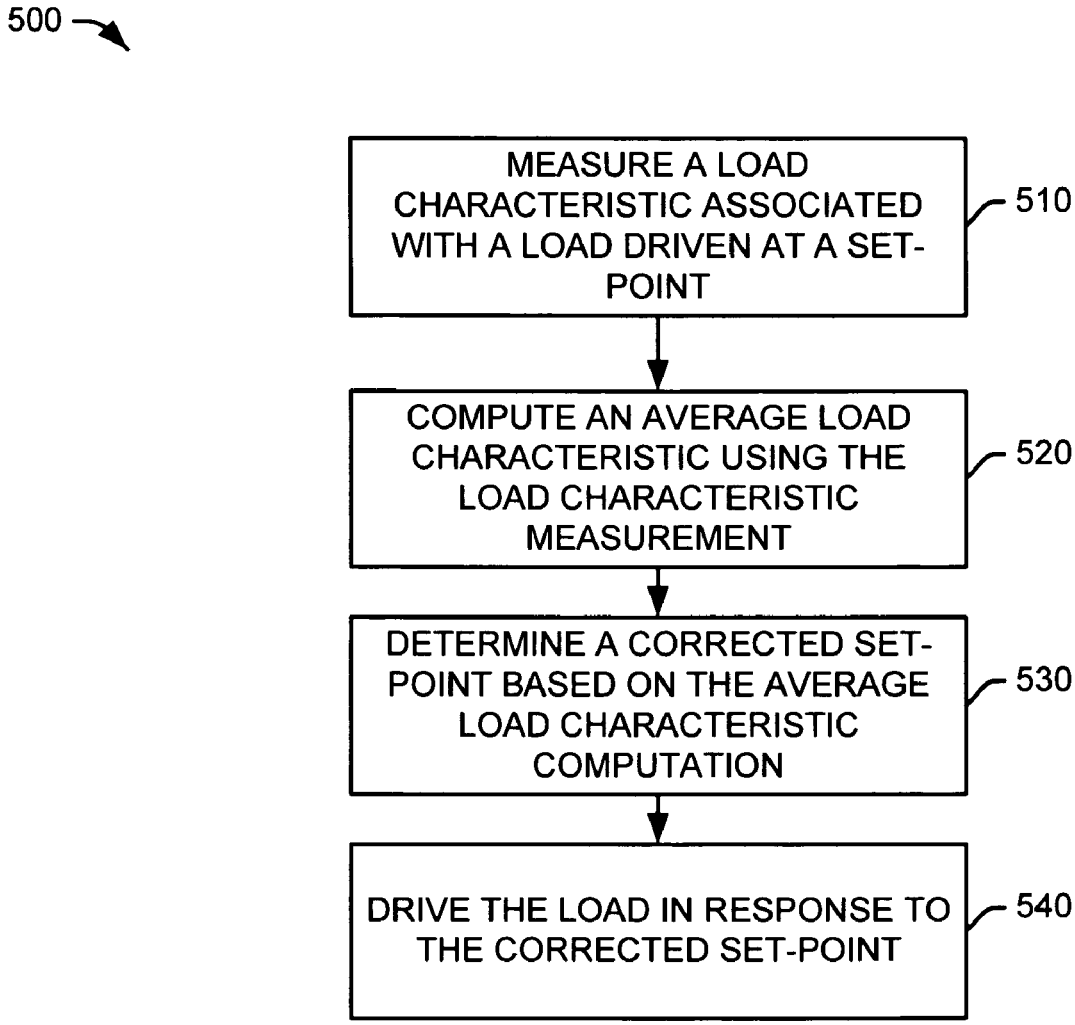
FIG. 5 is a flow chart of one method for driving a load according to one embodiment.
Figure 6:
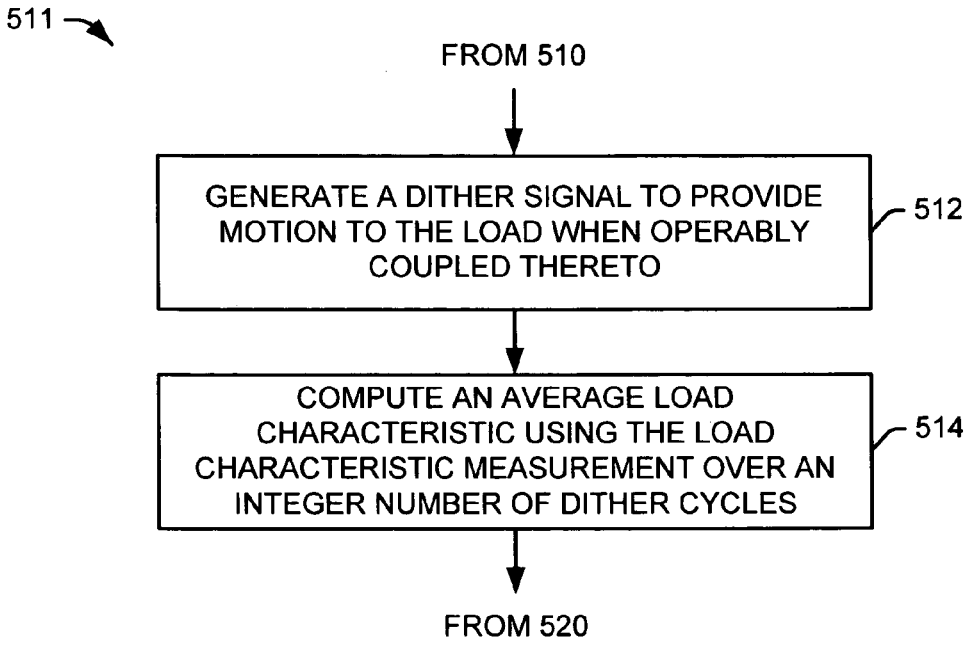
FIGS. 6 and 7 are flow charts of other embodiments of the method of FIG. 5, used for driving the load.
Figure 7:
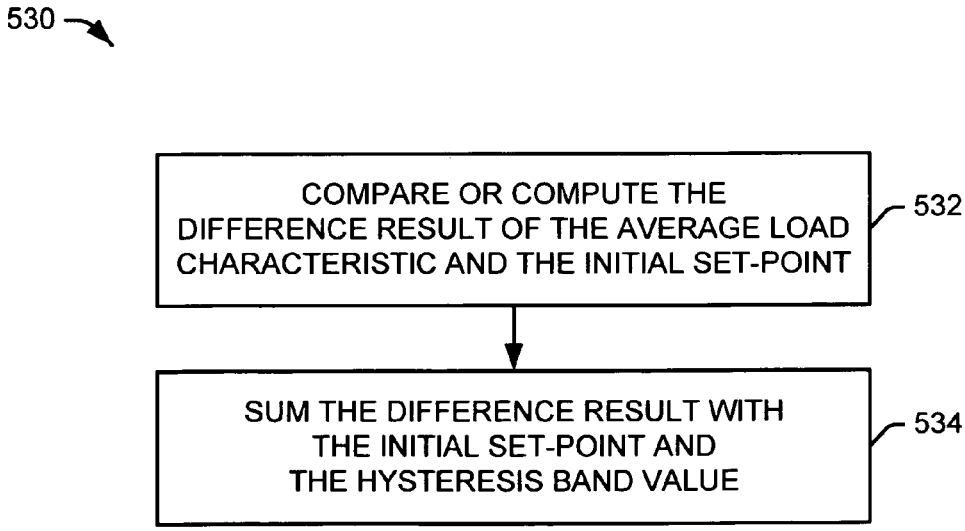

Referring now to FIGS. 5-7, one can see one or more embodiments of a method 500 in accordance with aspects of the present invention in the context of the control systems of FIGS. 1, 2A, and 2B. In the method 500, a load characteristic (in other embodiments, a load current, a voltage, a magnetic field, a light energy, or a power) associated with a load 206 (in other embodiments, a solenoid, a motor, a light, or an inductive load) driven at a set-point is measured and provided at 510. In one embodiment, this measurement 110 may be performed digitally using an analog to digital converter 118 to supply a digital word representation 110 of the load characteristic in order to better facilitate computations of the load characteristic measurements, for example, using software based averaging and other such math function programs.

At 520, an average load characteristic 130*b* is computed using the load characteristic measurement. In one embodiment, the averaging may be done by an average functional block 130 within the correction circuit 104, measured and averaged over a period of time, for example, a number of switch cycles or dither cycles, or another known time interval.

At 530, a corrected set-point 112 is determined based on the average load characteristic computation 130*b*. In one embodiment, a set-point of 500 mA is selected for a solenoid to operate at, and the set-point is compensated by the averaging 130 and correction 140 functions to provide a corrected set-point 112 that compensates for the load characteristics and dynamic variabilities of the system so as to provide a more accurate average current 130*b*.

At 540, the load 206 is driven in response to the corrected set-point 112. In one embodiment, the load 206 is driven by an output driver 124, for example, comprising a drive signal and a complementary drive signal.

In a further embodiment of method 500, and as illustrated at 511 in FIG. 6, after the load measurement of step 510, a dither signal 419 is generated at 512 to provide motion to the load 206 when operably coupled to the control system 100. Thereafter, at 514, an average load characteristic is computed using the load characteristic measurement 110 over an integer number of dither cycles 131*a*, and the method proceeds to step 520.

In another embodiment of step 530 of method 500, the corrected set-point 112 may be derived, as shown in FIG. 7, by comparing or computing the difference result of the average load characteristic 130*b* and the initial set-point 132*a* at step 532, and then summing the difference result 141 with the set-point 135 and the hysteretic band value 137 at step 534.

Although the invention has been illustrated and described with respect to one or more implementations, alterations and/or modifications may be made to the illustrated examples without departing from the spirit and scope of the appended claims.

For example, in one embodiment, the load could be a solenoid. Further such a solenoid could be employed in an automotive system, such as an automatic transmission. In other embodiments, the load could be any other loads that a user desires to drive at an average load characteristic and frequency.

Further, although in the illustrated embodiment, the first and second drive transistor devices are n-type metal-oxide semiconductor field effect transistors (MOSFETs), p-type MOSFETS could also be used including other types of switching devices (in other embodiments, transistors, bipolar junction transistors (BJTs), vacuum tubes, relays, etc.).

In another embodiment, one of the first and second drive transistors may be a diode, for example FET 212 of FIGS. 2A and 2B, wherein only FET 210 switches the load 206. In another exemplary embodiment of the present invention, the locations of the shunt 204 and load 206 may be reversed. In still another embodiment, the FETs 210 and 212 of FIGS. 2A and 2B may be located at the high side of the load, attached to the power supply Vbat 202 rather than to the ground Vgnd 203. Numerous other such variations are also possible within the spirit and scope of the invention, and as such are anticipated.

In addition, although various embodiments may indicate that a current delivered to the load could be increased if one voltage exceeds another, the conventions used herein could also be reversed. Thus, one will understand that increases or decreases in voltage or other variables could be transposed or otherwise rearranged in various embodiments.

Further, in various embodiments, portions of the control system 100 may be integrated into an integrated circuit, although in other embodiments the control system may be comprised of discrete devices. In one embodiment, the first and second devices or external drive components may be integrated into a single IC with the controller 102 and/or the correction circuit 104. The load characteristic sensor, for example, may be integrated into the same IC as the controller, or may be integrated into the same package as the controller, or may be integrated onto the same PCB board, or may be otherwise associated with the control system; depending on the implementation.

In particular regard to the various functions performed by the above described components or structures (blocks, units, engines, assemblies, devices, circuits, systems, etc.), the terms (including a reference to a "means") used to describe such components are intended to correspond, unless otherwise indicated, to any component or structure which performs the specified function of the described component (or another functionally equivalent embodiment), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising". In addition, to the extent that the terms "number", "plurality", "series", or variants thereof are used in the detailed description or claims, such terms are to include any number including, but not limited to: positive integers, negative integers, zero, and other values.

What is claimed is:

1. A control system, comprising:

a controller configured to drive a load based on a set-point of the load, and further configured to measure a load characteristic of the load, and compute an average load characteristic, and to determine a corrected set-point based on the computed average, wherein the controller is configured to determine the corrected set-point by comparing the average load characteristic to an initial set-point, and summing the result thereof with the initial set-point and a hysteretic band value, and wherein the controller is further configured to drive the load in response to the corrected set-point.

2. The system of claim 1, wherein the load characteristic is one of a load current, a voltage, a magnetic field, a light energy, and a power of the load.

3. The system of claim 1, wherein the controller further comprises a dither generator configured to generate a dither signal to provide substantially continuous motion to the load when operably coupled thereto, and provide a time base source for the average load characteristic computation, wherein the controller computes the average load characteristic over an integer number of dither cycles.

4. The system of claim 1, wherein the average load characteristic is computed over an integer number of load switching cycles.

5. The system of claim 1, wherein the controller is further configured to digitally measure the load characteristic of the load.

6. A compensated hysteretic control system, comprising:

measurement means for measuring a load characteristic associated with a load;

output means for driving the load according to a set-point of the load; and control means for computing an average load characteristic from the measured load characteristic and determining a corrected set-point, wherein the control means is configured to determine the corrected set-point by comparing the average load characteristic to an initial set-point, and summing the result thereof with the initial set-point and a hysteretic band value, and wherein the output means drives the load in response to the corrected set-point.

7. The system of claim 6, wherein the load characteristic is one of a load current, a voltage, a magnetic field, a light energy, and a power of the load.

8. The system of claim 6, wherein the control means is further configured to generate a dither signal to provide substantially continuous motion to the load when operably coupled thereto, wherein the dither signal provides a time base for the average load characteristic computation, and wherein the controller computes the average load characteristic over an integer number of dither cycles.

9. The system of claim 6, wherein the average load characteristic is computed over an integer number of load switching cycles.

10. The system of claim 6, wherein the control means is further configured to digitally measure the load characteristic of the load.

11. A control system, comprising:

a controller configured to digitally measure a load characteristic of a load at an input thereof, and further configured to drive the load based on a set-point of the load; and a correction circuit configured to compute an average load characteristic using the measured load characteristic over an integer number of cycles, and further configured to determine a corrected set-point by comparing the average load characteristic to an earlier set-point, and summing the result thereof with the initial set-point and a hysteretic band value;

wherein the controller is further configured to drive the load in response to the corrected set-point determined by the correction circuit.

12. The system of claim 11, wherein the load characteristic is one of a load current, a voltage, a magnetic field, a light energy, and a power of the load.

13. The system of claim 11, wherein the correction circuit further comprises a dither generator configured to generate a dither signal to provide substantially continuous motion to the load when operably coupled thereto, and provide a time base source for computing the average load characteristic over an integer number of dither cycles.

14. The system of claim 11, wherein the average load characteristic is computed over an integer number of load switching cycles.

15. The system of claim 11, wherein the hysteretic band value corresponds to an ON or OFF status of the load driver.

16. A method of controlling an average current in a load comprising:

measuring a load characteristic associated with the load when driven at a set-point;

generating a dither signal to provide substantially continuous motion to the load when operably coupled thereto;

computing an average load characteristic based on the load characteristic measurement over an integer number of dither cycles;

determining a corrected set-point based on the average load characteristic computation; and driving the load in response to the corrected set-point.

17. The method of claim 16, wherein the load characteristic is one of a load current, a voltage, a magnetic field, a light energy, and a power of the load.

18. The method of claim 16, wherein measuring the load characteristic comprises digitally measuring the load characteristic of the load.

19. The method of claim 18, wherein computing an average load characteristic comprises using and averaging the measured load characteristic over an integer number of cycles.

20. The method of claim 19, wherein determining a corrected set-point comprises comparing the average load characteristic to an initial set-point, and summing the result thereof with the initial set-point and a hysteretic band value.

21. The method of claim 20, wherein the hysteretic band value corresponds to an ON or OFF status of the load driving.

* * * * *